US009179710B2

(12) United States Patent
Chaoui

(10) Patent No.: US 9,179,710 B2
(45) Date of Patent: Nov. 10, 2015

(54) HOOKAH WITH MULTIPLE TOBACCO BOWLS

(75) Inventor: Rani A. Chaoui, El Cajon, CA (US)

(73) Assignee: Inhale, Inc., Santee, CA (US)

( * ) Notice: Subject to any disclaimer, the term of this patent is extended or adjusted under 35 U.S.C. 154(b) by 189 days.

(21) Appl. No.: 12/494,281

(22) Filed: Jun. 30, 2009

(65) Prior Publication Data

US 2010/0326453 A1 Dec. 30, 2010

(51) Int. Cl.
*A24F 1/14* (2006.01)
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS

| | | | | |
|---|---|---|---|---|
| 738,235 | A | 9/1903 | Pforntner | |
| D547,489 | S | 7/2007 | Kassir | |
| D547,902 | S | 7/2007 | Kassir | |
| D548,398 | S | 8/2007 | Chaoui | |
| D554,797 | S | 11/2007 | Kassir | |
| D561,388 | S | 2/2008 | Kassir | |
| 2004/0163658 | A1* | 8/2004 | Mehio | 131/191 |
| 2007/0056599 | A1* | 3/2007 | Zoumut | 131/329 |

OTHER PUBLICATIONS http://www.hookah-shisha.com/store/pc/configurePrd.asp?idcategory=27&idproduci=1372.
http://www.hookah-shisha.com/store/pc/viewCat_h.asp?idCategory=2.
http://www.hookahlounge.net/prepare-hookah.php.
http://www.smoking-hookah.com/editorials/SettingUpYourHookah.asp.

* cited by examiner

*Primary Examiner* — Richard Crispino
*Assistant Examiner* — Phu Nguyen
(74) *Attorney, Agent, or Firm* — Louis F. Teran

(57) ABSTRACT

The present invention relates to a Hookah otherwise known as a water pipe or Nargile. The hookah is used to smoke tobacco or other herbs that are heated using a hot charcoal. With multiple tobacco bowls, this hookah allows the user to consume a mixture of smoke from different flavored tobaccos. The various bowls are independent from each other and spaced apart so that the heat from one does not affect the others. The spacing of the bowls also protects the user from burn injuries while replacing the tobacco or charcoal in each bowl. The smoke from each bowl is directed into a stem tube where it is mixed before being filtered and cooled by water in preparation for consumption. Each tobacco bowl can be connected to a flow control device that allows the user to fine tune the amount of smoke from each bowl and achieve the preferred flavor.

8 Claims, 12 Drawing Sheets

HOOKAH WITH MULTIPLE TOBACCO BOWLS

BACKGROUND OF THE INVENTION

1. Field of the Invention

The present invention relates generally to the field of devices known as Hookahs otherwise known as water pipes or Nargiles. More specifically, the invention relates to a hookah comprising a main stem tube that branches off into various tubes to which various tobacco bowls are attached. The tobacco placed in the various tobacco bowls is heated with hot charcoals to create smoke that is blended within the main stem tube before it is directed into water in a container to be filtered and cooled so that it may be inhaled by the user. The tobacco bowls are properly spaced apart so that the heat radiating from the hot charcoals on each bowl do not affect the smoke created by the tobacco in another bowl and the user runs less risk of burning a hand by a hot charcoal on one bowl or destabilizing the bowls when changing the charcoal or tobacco on another bowl.

2. Description of the Prior Art

A hookah is a smoking device or a water pipe that has been used for centuries to smoke tobacco, mixtures of various herbs, or mixtures of both. The general concept of a hookah has been in existence for centuries with original popularity tracing back to Turkey around the years 1623-1640 where they became an important part of coffee shop culture and the preferred way of smoking tobacco. Generally, a hookah directs the smoke generated from the tobacco or herbs through water for cooling and filtration purposes. Undesirable smoke byproducts such as tar, oil, ashes, carbon monoxide, and the like are absorbed or separated in the water before the smoke is inhaled by the user.

Typically a hookah has a single tobacco bowl mounted at the top and a container at the bottom. The container is filled with water and a tubular hollow stem extends downward from the bowl into the container with its lowermost extremity immersed in the water. The body of the hookah is located directly above the container and has a hollow interior that forms a smoke chamber through which the hollow stem tube extends. A flexible hose is then connected to the smoke chamber and extends outward from the body of the hookah. Finally, a mouthpiece is attached at the distal end of the flexible hose through which the user can inhale the smoke.

Tobacco or herb is placed on the bowl. The bowl is then covered typically with a piece of foil paper having multiple holes. A piece of hot charcoal is then placed on top of the foil paper to heat the tobacco or herb within the bowl without making direct contact with the tobacco or herb. Direct contact between the hot charcoal and the tobacco or herb can lead to burning rather than heating or smoking. As the tobacco or herb is heated, it generates smoke. When the user inhales through the mouthpiece attached to the flexible hose, the smoke is drawn from the bowl through the stem tube and into the water. The smoke then passes upwards through the water in the form of bubbles and into the smoke chamber. When sufficient smoke is collected in the smoke chamber, it passes through the flexible hose to the user for inhalation. As the smoke is drawn through the water, it is filtered and cooled to make the smoking experience pleasant and enjoyable for the user.

The primary mechanism of a hookah is the inhalation of the human smoker from the mouthpiece to create the vacuum or negative pressure required to draw smoke through the filtering and cooling water into the smoke chamber. The vacuum or negative pressure in turn influences the combustion rate of the tobacco or herb. The flavors of the smoke from the tobacco can be influenced by the combustion rate.

Unlike smoke from hookah, smoke from cigarettes is filled with products of combustion, many of which are known carcinogens. Furthermore, smoking a hookah is preferred over smoking cigarettes or cigars because of the flavorful and cool taste of the smoke. Typical tobacco used with a hookah includes a mixture of shredded tobacco leaf mixed with a sweetener such as honey, molasses, or semi-dried fruit.

Most hookah tobaccos are mixed with tobacco flavors, such as, apple, strawberry, vanilla, mint, etc. Many hookah smokers prefer a combination or mixture of flavors, such as apple flavored tobacco mixed with strawberry flavored tobacco. Manufacturers of hookah tobacco have responded to this trend by offering tobacco that is pre-mixed with multiple flavors. However, the infinite mixtures of flavored tobacco makes it impossible for hookah tobacco manufacturers to offer every possible combination. As a result, hookah smokers often hand mix different types of flavored tobacco themselves to attain the mixed flavor of their liking. This technique of hand mixing different flavored tobacco is cumbersome and messy.

An alternative to hand mixing different flavored hookah tobacco is to use a multi-headed hookah bowl that is available in the marketplace. Double, triple, and quadruple headed hookah bowls are known in the marketplace. As shown in FIG. 7, such multi-headed hookah bowls are designed with multiple bowls arranged closely together and attached to a single outlet point that is directly connected to the single stem tube of a hookah. Each bowl can be filled with different flavored tobacco and heated with different charcoals. The smoke of the different flavored tobacco converge and mix at the single outlet point of the multi-headed bowl before it enters the stem tube of the hookah.

A disadvantage of multi-headed bowls is that the bowls are clustered too close to each other. The heat radiating from one charcoal on one bowl increases the heat exposure to other bowls, thus affecting the combustion rate of the tobacco in the other bowls. Therefore, such close proximity of bowls makes it very difficult to control the flavor of the smoke inhaled by the user of the hookah. In addition to the amount of different flavored tobacco in each head, the amount of heat radiating from each charcoal becomes another variable that the user of the hookah must control to be able to duplicate the desired flavor on a consistent basis.

Secondly, the multi-headed bowls are difficult to use because the weight placed on each bowl can tilt the entire unit in any one direction, especially as the charcoal and tobacco on one bowl burns faster than the charcoal and tobacco on another bowl. The weight variance on each bowl can tilt the entire unit to the point when the entire unit falls off the hookah. Additionally, as charcoal on one bowl is replaced or the tobacco in one bowl is refilled, the user can easily knock the entire unit off the stem of the hookah or burn a hand due to the close proximity to other hot charcoal on other bowls.

Thirdly, another disadvantage of the multi-headed bowls is the difficulty of controlling or fine-tuning the amount of smoke from each flavored tobacco in the final smoke mixture that is inhaled by the user of the hookah. Since the different flavored smoke from each bowl are mixed together at close proximity to their source, it is difficult to deviate from a mixture of equal parts of each flavored smoke. There is no mechanism for the user to control the amount of smoke of each tobacco added to the final mixture. Additionally, controlling the combustion rate and hence the amount and quality of smoke released by each tobacco is difficult due to the heat radiating from the other bowls that are close in proximity.

What is needed to overcome the various disadvantages evident in the prior art is a hookah or water pipe that has multiple independent bowls for different flavored tobacco with sufficient distance between them that the heat radiating from the charcoal on each bowl does not affect the combustion rate of the tobacco in the other bowls. Secondly, the hookah must allow the user to replace the charcoal or refill the tobacco in each bowl without affecting or disturbing the other bowls. Finally, the hookah would have a mechanism for the user to control the amount of flavored smoke released from each bowl so that the mixed smoke that is ultimately inhaled by the user can be fine-tuned to the desired flavor. Such a hookah would combine the advantages of the prior art while eliminating their various respective disadvantages. As will be seen, this improved hookah achieves these objectives and advantages with a minimum of functioning parts in a novel, nonobvious, and useful combination.

SUMMARY OF THE INVENTION

Accordingly, the present invention has been made in view of the above-mentioned disadvantages occurring in the prior art, and it is the object of the present invention to provide a hookah or water pipe capable of allowing the user to consistently mix the desired combination of smoke from different tobaccos or herbs.

It is another object of the present invention to provide a hookah or water pipe that has multiple bowls into which different types of tobacco can be placed and heated with different hot charcoals and that are spaced apart so that the heat radiating from one charcoal will not affect the combustion rate or smoke of the other tobacco.

It is another object of the present invention to provide a hookah or water pipe that has multiple bowls that connect to different tubes that have a mechanism to allow the user to control or fine tune that amount of smoke from each bowl that is added to the final mixture of smoke inhaled by the user.

It is another object of the present invention to provide a hookah or water pipe that has multiple bowls and a mechanism connected to each bowl that allows the user to close each bowl independently and only inhale smoke from the other bowls that have not been closed.

To accomplish the above objects, the present invention is embodied in a hookah or water pipe comprising a main stem tube that branches off into various tubes to which various bowls are connected. The different smoke created from the tobacco in the various bowls are mixed or blended within the main stem tube before it is directed downward into the water in the container so that the smoke being inhaled by the user is the preferred blend of smoke that is cooled and filtered by the water. The various bowls are properly spaced apart so that the heat radiating from the hot charcoals on each bowl do not affect the smoke created by the tobacco in another bowl and the user runs less risk of burning a hand by a hot charcoal on one bowl when changing a hot charcoal or tobacco on another bowl.

Another embodiment of the present invention is a hookah or water pipe with a flow control device connected inline within each tube to which different tobacco bowls are attached. The flow control device allows the user to fine tune or block off the amount of smoke flowing out of each bowl, through each tube, and into the main stem tube before inhalation by the user.

The above and other features and advantages of the present invention, as well as the structure and operation of various embodiments of the present invention, are described in detail below with reference to the accompanying drawings.

DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functional similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Reference will now be made to the drawings in which various elements of the present invention will be given numerical designations and in which the invention will be discussed so as to enable one skilled in the art to make and use the invention.

Figure 1:
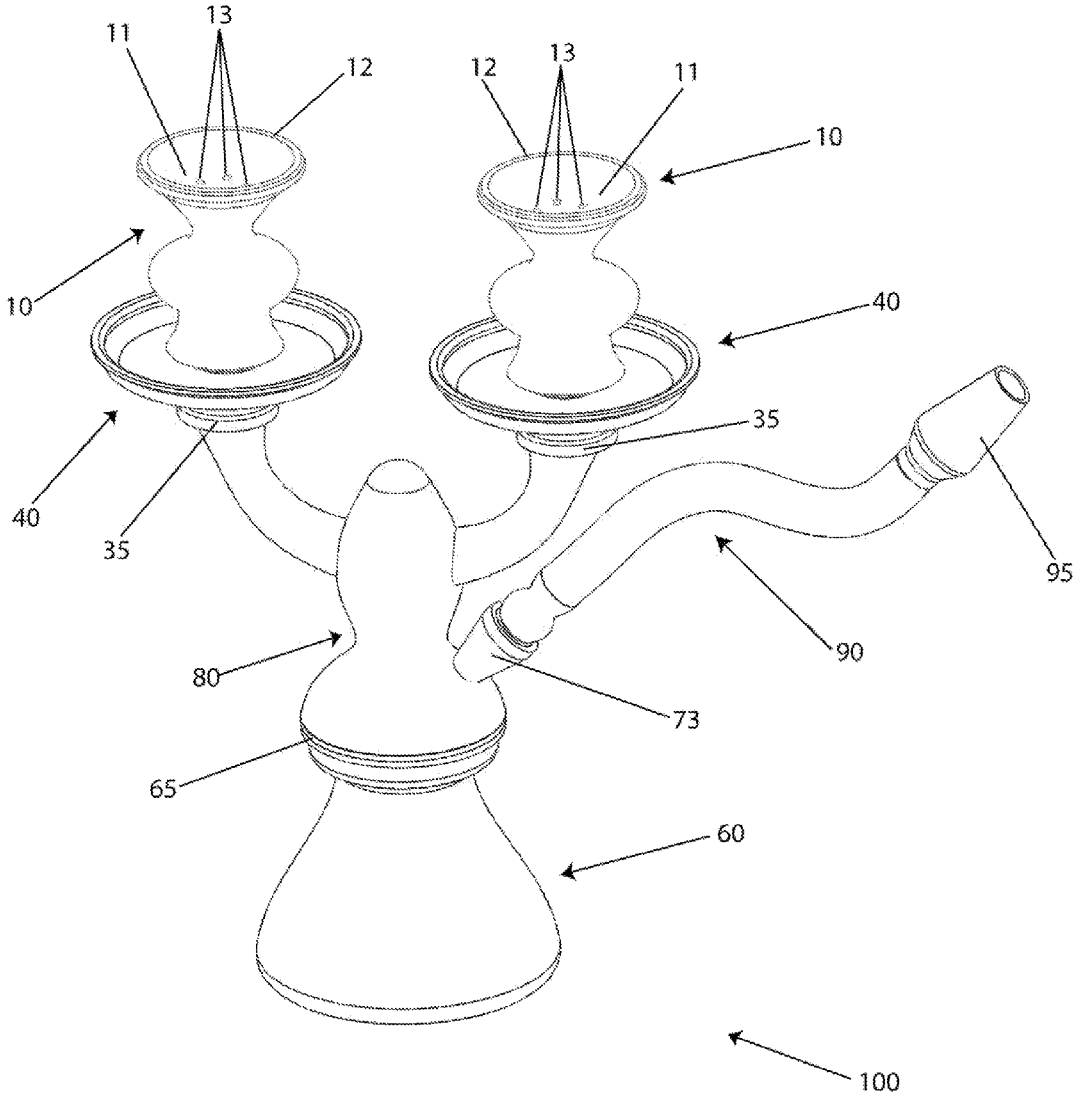
FIG. 1 shows a hookah or water pipe with multiple tobacco bowls according to the first embodiment of the present invention.
Figure 2:
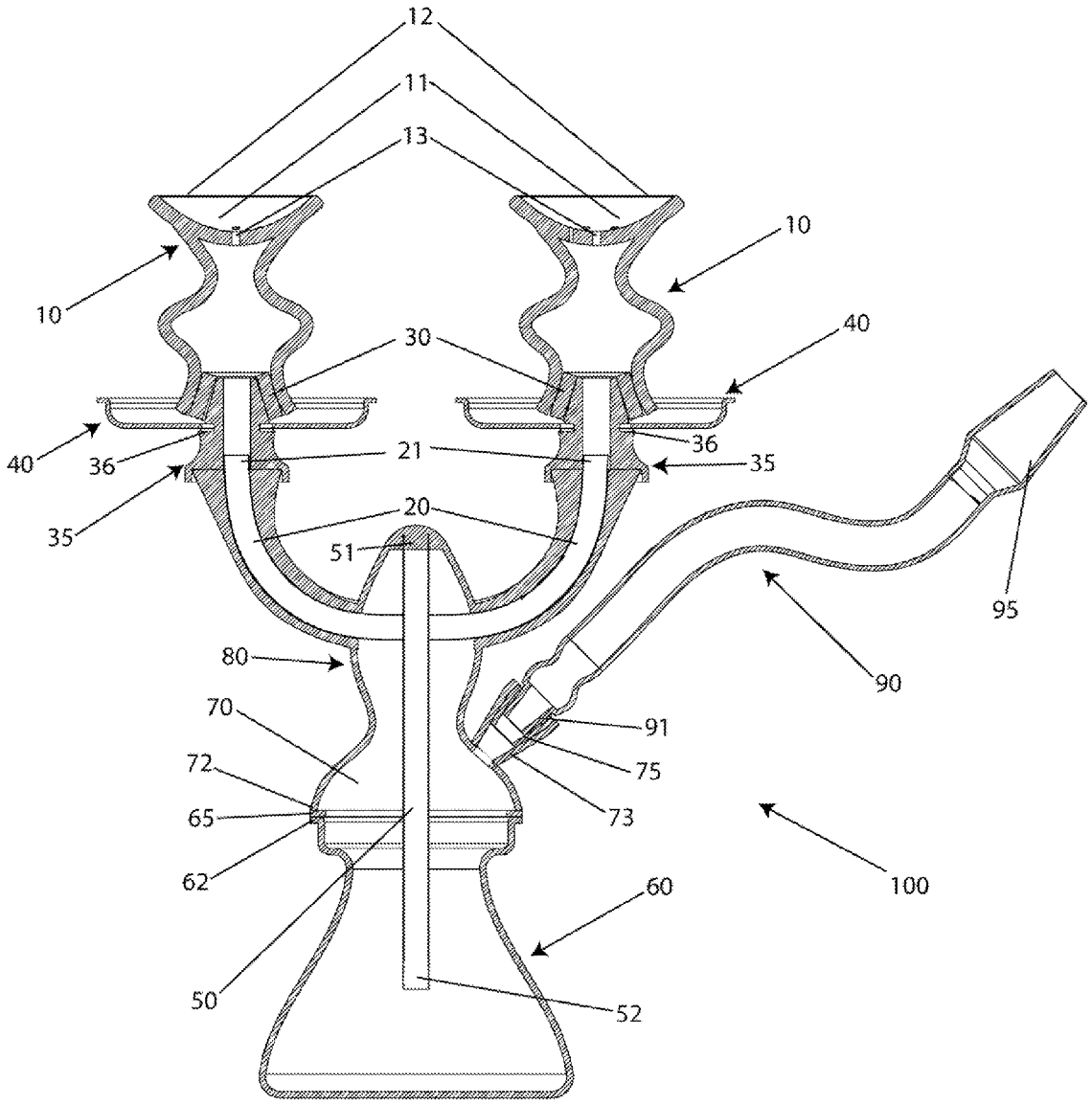
FIG. 2 shows a sectional view of a hookah or water pipe with multiple tobacco bowls attached to multiple tubes that are connected to the main stem tube according to the first embodiment of the present invention.

As shown in FIG. 1 and FIG. 2, the present invention is designed and engineered to have multiple bowls 10 that are in communication with multiple tubes 20 that are attached to the main stem tube 50 to allow the user to blend a mixture of smoke from different flavored tobacco in each bowl 10 without having to hand mix and without worrying that the heat radiating from the hot charcoal 230 in one bowl 10 will affect the smoke created from the tobacco in another bowl 10.

Figure 7:
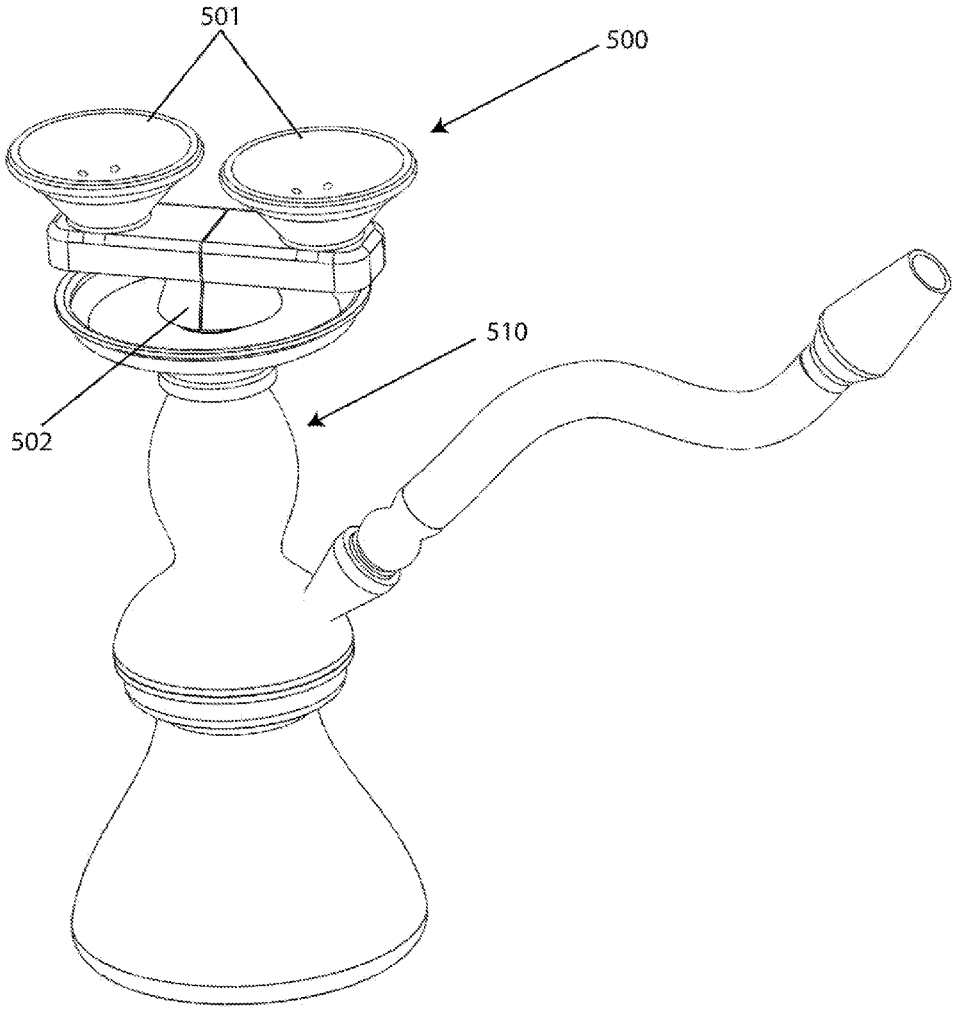
FIG. 7 (Prior Art)
FIG. 7 shows the prior art described above as the multi-headed bowl assembled to a typical single stem hookah and that is currently available in the marketplace.

FIG. 7 shows the prior art known as the multi-headed bowl 500 assembled to a typical single stem hookah 510 and that is available in the marketplace. The various bowls 501 of a multi-headed bowl 500 are clustered close together and converge at a single outlet 502 that is connected to the stem tube of the single stem hookah 510. The bowls 501 are so close to each other that the heat radiating from the hot charcoal on one bowl affects the heat in the other bowl thus affecting the combustion rate of the tobacco in that bowl. Further, the attachment of the multi-headed bowl 500 to the single stem of the hookah 510 is not stable and makes it easy for it to fall off the hookah 510 while the user refills or replaces the tobacco or charcoal in one of the bowls 501. Finally, the close proximity of the bowls 501 to each other makes it easy for the user to be burned or injured by the hot charcoal in one of the bowls while replacing the tobacco in another bowl.

Figure 3:
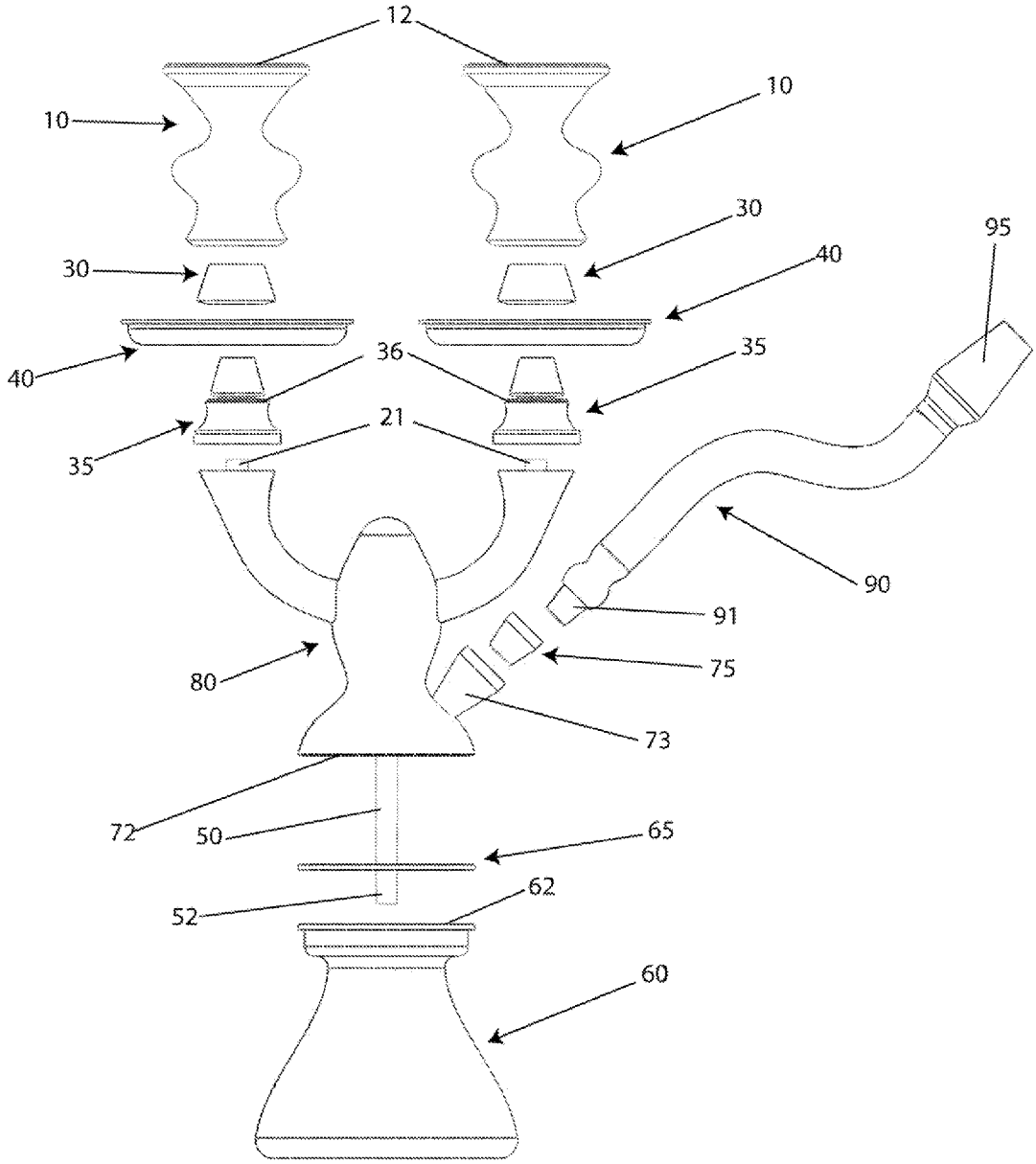
FIG. 3 shows an exploded view of a hookah or water pipe with multiple tobacco bowls according to the first embodiment of the present invention.
Figure 4:
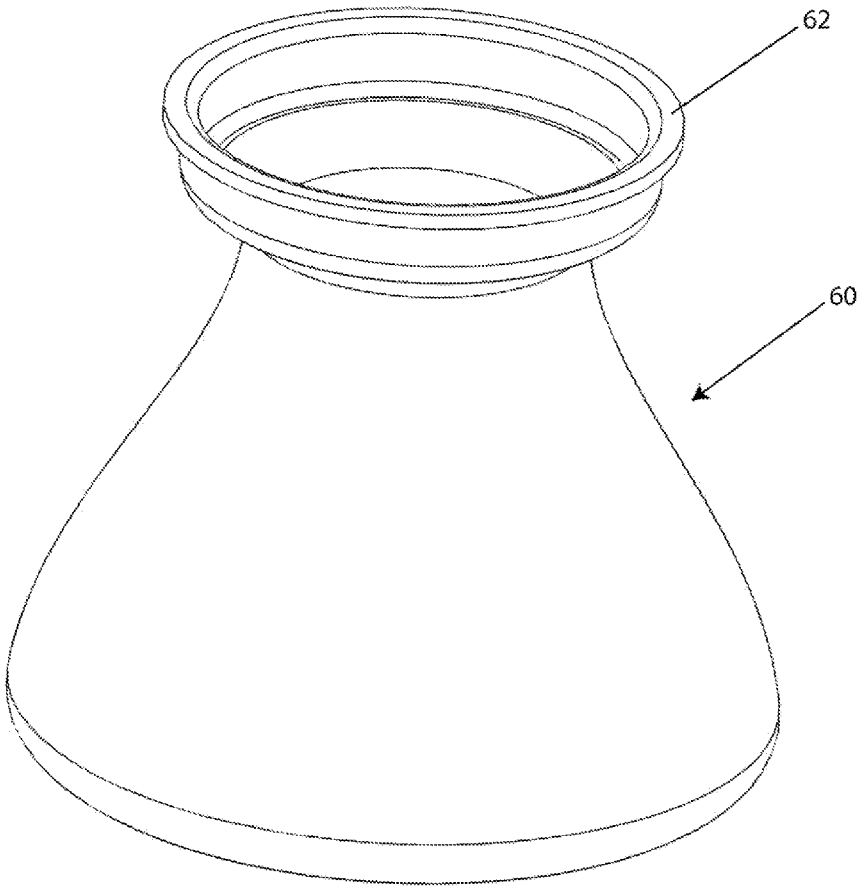
FIG. 4 shows a container used in a hookah or water pipe with multiple tobacco bowls according to the first and second embodiment of the present invention.
Figure 5:
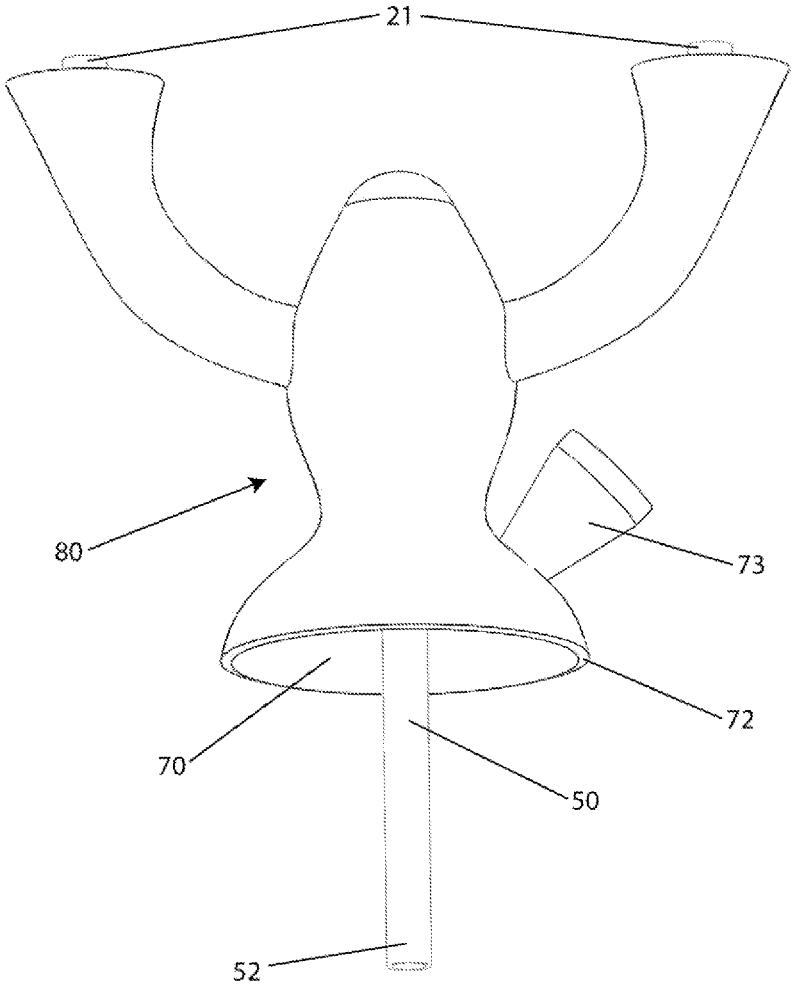
FIG. 5 shows a hookah body used in a hookah or water pipe with multiple tobacco bowls according to the first and second embodiment of the present invention.
Figure 6:
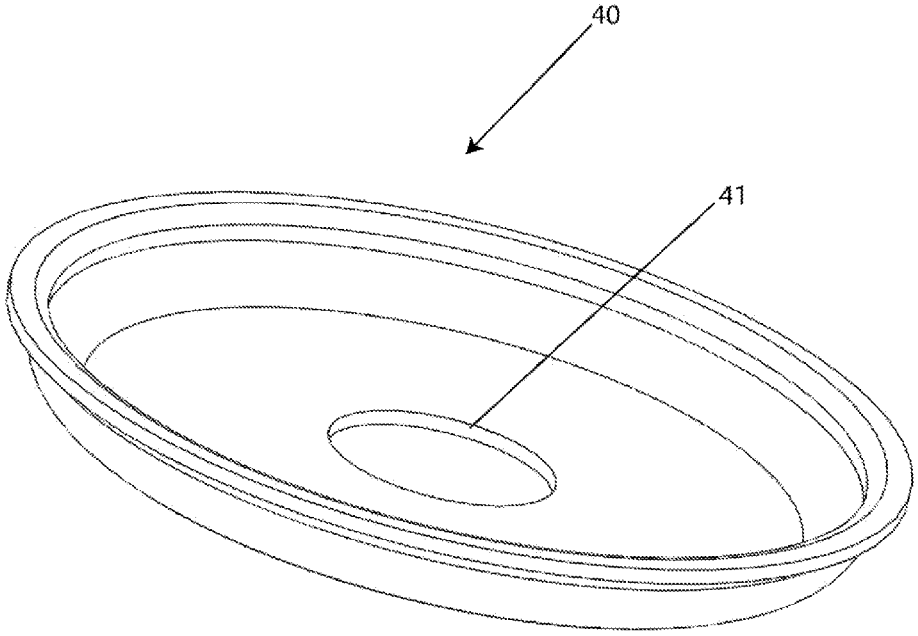
FIG. 6 shows a plate used in a hookah or water pipe with multiple tobacco bowls according to the present invention.

FIG. 2 and FIG. 3 show a hookah or water pipe 100 with multiple bowls 10 according to the first embodiment of the present invention and begin to illustrate elements thereof that overcome the drawbacks and disadvantages of the prior art. Bowl holders 35 are securely attached with an airtight seal to the top end of each tube 21 that extends out of the body of the hookah 80. Rubber grommets 30 are placed over the bowl holders 35 and the bowls 10 are pushed tightly over the rubber grommets 30 to create an airtight seal between the bowls 10 and each tube 20. Underneath the rubber grommets 30 and bowls 10, a plate 40 is rested on each bowl holder 35 so that it may catch any ash or tobacco that may fall off the bowls 10.

It is preferred that all the tubes 20 have the same inner and outer diameter so that the flow characteristics of the smoke are the same in all the tubes 20. The tubes 20 extend downward until they all connect to the main stem tube 50. The main stem tube 50 preferably has the same inner and outer diameter as the other tubes 20 and is configured straight and vertical so that its lowermost extremity 52 extends into a container 60. The main stem tube 50 is secured from its top end 51 by the body of the hookah 80 and extends through a smoke chamber 70 formed inside the body of the hookah 80.

In the preferred embodiment, the top face 62 of the container 60 is attached to the smoke chamber 70 at its bottom face 72 with a container seal 65 so that the smoke does not escape out to the atmosphere. Once attached, the smoke chamber 70 is in communication with the container 60 such that smoke is allowed to rise or diffuse from the container 60 to the smoke chamber 70. A hose connector 73 is attached to the body of the hookah 80 to create a passageway from the outside atmosphere into the smoke chamber 70. As the smoke chamber 70 is filled with smoke, its only exit path is through the hose connector 73, through a hose 90 connected to the hose connector 73, and out of a mouthpiece 95 that is attached to the distal end of the hose 90.

Hereinafter, an explanation on the methods of packaging and distributing the product of the present invention, the operating states thereof, and the usage thereof will be given.

For the distribution of the product of the present invention, various parts, that is, the body of the hookah 80 assembled with the tubes 20, the main stem tube 50, the hose connectors 73, and the bowl holders 35, the plates 40, the rubber grommets 30, the bowls 10, the container 60, the container seal 65, the hose connector rubber grommets 75, and the hoses 90 each assembled with a mouthpiece 95 are individually packaged, and then, they are assembled by a user before the use.

Now, an explanation of the use of the state of the product of the present invention adapted to have multiple bowls 10 that attach to multiple tubes 20 that are attached to the main stem tube 50 to allow the user to consistently blend a mixture of smoke from different flavored tobacco in each bowl 10 without having to hand mix and without worrying that the heat radiating from the hot charcoal 230 in one bowl 10 will affect the smoke created from the tobacco in another bowl 10.

According to the present invention, the hookah or water pipe is adapted to have multiple plates 40, bowls 10, bowl holders 35, and rubber grommets 30 that assemble to the top end of each tube 21. First the bowl holders 35 are attached directly to the top of each tube 21. Second, the plates 40 have a circular hole 41 at the center. Each plate 40 is slipped over each bowl holder 35 through the circular hole 41 so that the plate 40 rests on the plate stop 36. Third, the rubber grommets 30 are slipped over each bowl holder 35. Finally, each bowl 10 is pushed over each rubber grommet 30 until it is held securely on the bowl holder 35 and in communication with the tube 20 with an airtight seal to direct the smoke from the tobacco or herb through the tube 20 and prevent it from exiting the system.

Next, the container 60 is filled with water to almost three quarter of the way to the top. The container seal 65 is then placed on the top face 62 of the container 60. Thirdly, the body of the hookah 80 is securely assembled to the container 60 so that the top face 62 of the container 60 and the bottom face 72 of the smoke chamber 70 tightly seal against the container seal 65. Once attached, the smoke chamber 70 is in communication with the container 60 such that smoke is allowed to rise or diffuse between the container 60 and the smoke chamber 70. When the body of the hookah 80 is securely assembled to the container 60, the lowermost extremity 52 of the main stem tube 50 must be immersed in the water in the container 60.

After the hookah or water pipe is moved to its preferred location for easy access by the user while smoking from it, the connecting end 91 of the hoses 90 are inserted into the hose connectors 73 that are attached to the body of the hookah 80. A hose connector rubber grommet 75 is used to create an airtight seal between the hose 90 and the hose connector 73. Once the hoses 90 are connected, they create a passageway from the smoke chamber 70 out to the atmosphere through the mouthpiece 95.

After the hookah or water pipe is assembled, the user should make sure that all the connections are airtight so that air can only enter through the holes 13 on the top surface 11 of each bowl 10 and can only exit out the mouthpieces 95 at the end of each hose 90.

Figure 8:
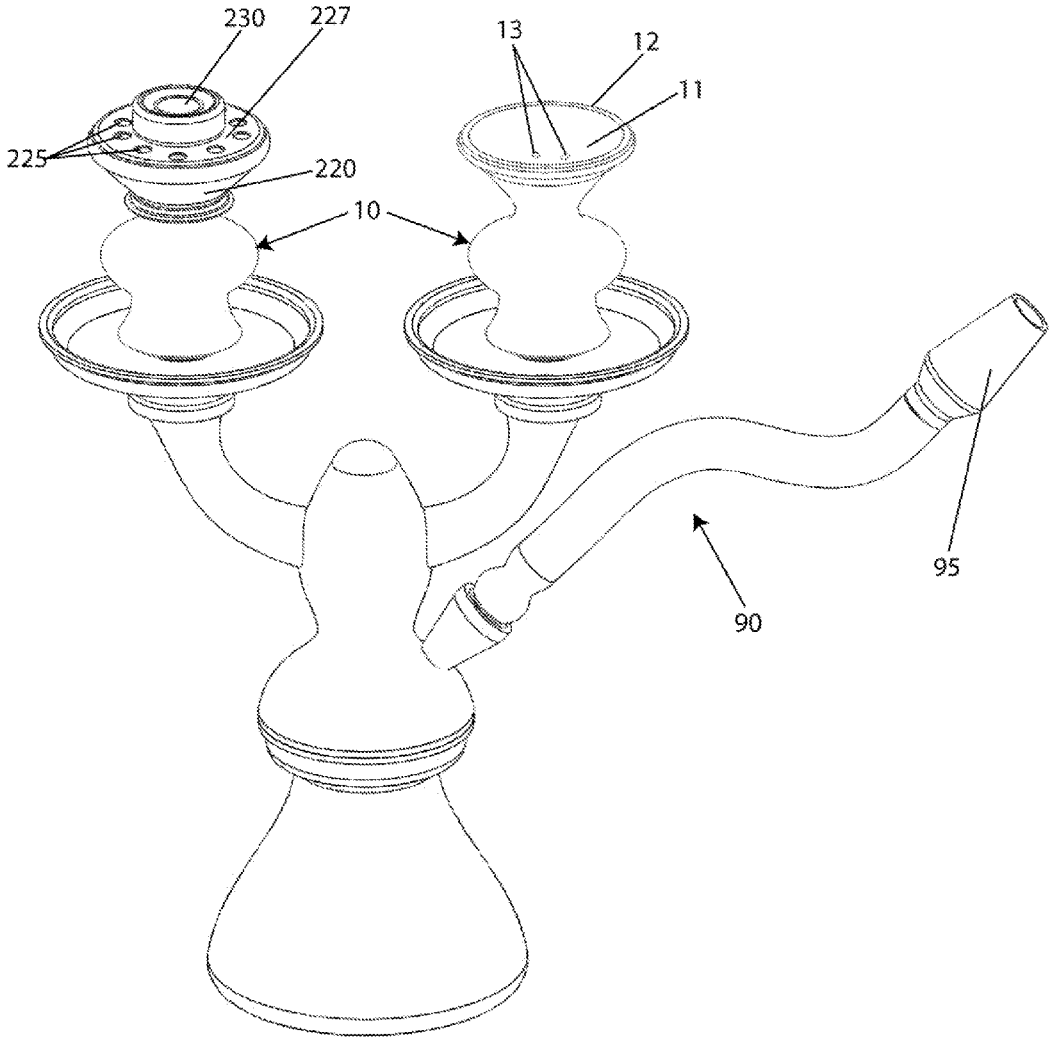
FIG. 8 shows a hookah or water pipe with multiple tobacco bowls set up for use according to the first embodiment of the present invention.

As shown on FIG. 8, to prepare the hookah or water pipe for smoking, the user first places tobacco on the top surface 11 of each bowl 10. Then the top of each bowl 12 is tightly covered, typically with foil paper 220, to create a resilient top surface 227. Third, a piece of hot charcoal 230 is placed on the resilient top surface 227 so that it never comes in direct contact with the tobacco or herb. Direct contact between the hot charcoal and the tobacco or herb can lead to burning rather than heating and smoking of the tobacco or herb. The foil paper 220 is punctured to create holes 225 so as to facilitate the heat exchange between the hot charcoal 230 that is placed on the foil paper 220 and the tobacco that is underneath the foil paper 220 on the top surface 11 of each bowl 10.

The heat from the hot charcoal 230 is transferred to the foil paper 220 through conduction. The heat is then transferred to the tobacco directly underneath the foil paper 220 through radiation and convection caused by an air flow introduced from the outside through the holes 225 on the foil paper 220. As the tobacco is heated, it begins to release smoke.

When the user inhales through the mouthpiece 95 at the end of one of the hoses 90, air is drawn from the outside atmosphere through the holes 225 on the foil paper 220 to increase the convective heat exchange between the hot charcoal 230 and the tobacco. As the tobacco is heated, smoke is drawn from the tobacco through the holes 13 on the top surface 11 of each bowl 10 and through the tubes 20. The smoke in each tube 20 then converges and mixes within the main stem tube 50 before it is drawn into the water in the container 60. The mixed smoke then passes upward through the water in the form of bubbles and into the smoke chamber 70. When sufficient smoke is collected in the smoke chamber 70, it passes through the hose 90 to the user for inhalation.

Thus within a few seconds after the user begins inhaling through one of the mouthpieces 95, the user begins receiving a smoke that is a mixture of the smoke coming from the different tobacco in each of the bowls 10.

The preferred embodiment of the present invention is superior to the prior art shown on FIG. 7 because each of the bowls 10 are attached to different tubes 20 that are spaced apart from each other so that the heat radiating from the hot charcoals 230 will not affect the heat exposure to the tobacco on the other bowls 10. In other words, the bowls 10 are physically separated from one another by a sufficient distance that prevents the heat radiating from one charcoal 230 over one of the bowls 10 from heating any of the other bowls 10. As shown in FIGS. 1 and 2, the distance between the bowls 10, in the preferred embodiment, can be at least the full diameter of said bowls 10. However, the proper distance between the bowls 10 is dependent on the size of the charcoal and the amount of heat radiating therefrom. Calculating the proper distance between the bowls 10 is readily achieved by a person skilled in the art by taking into consideration the size of the charcoal 230 and the amount of heat radiating therefrom. Further, since the bowls 10 are spaced apart from each other, the user runs less risk of being burned or injured by the hot charcoals 230 on the other bowls 10 when replacing the tobacco or hot charcoal 230. Thirdly, since the bowls 10 are independent from each other, the user runs less risk of tilting, destabilizing, or knocking the other bowls 10 off the tube 20 when replacing the tobacco or hot charcoal 230 on one of the bowls 10. Finally, the separation of the bowls allows the smoke from each bowl to properly blend together into a homogeneous mixture of flavored tobacco smoke.

Figure 9:
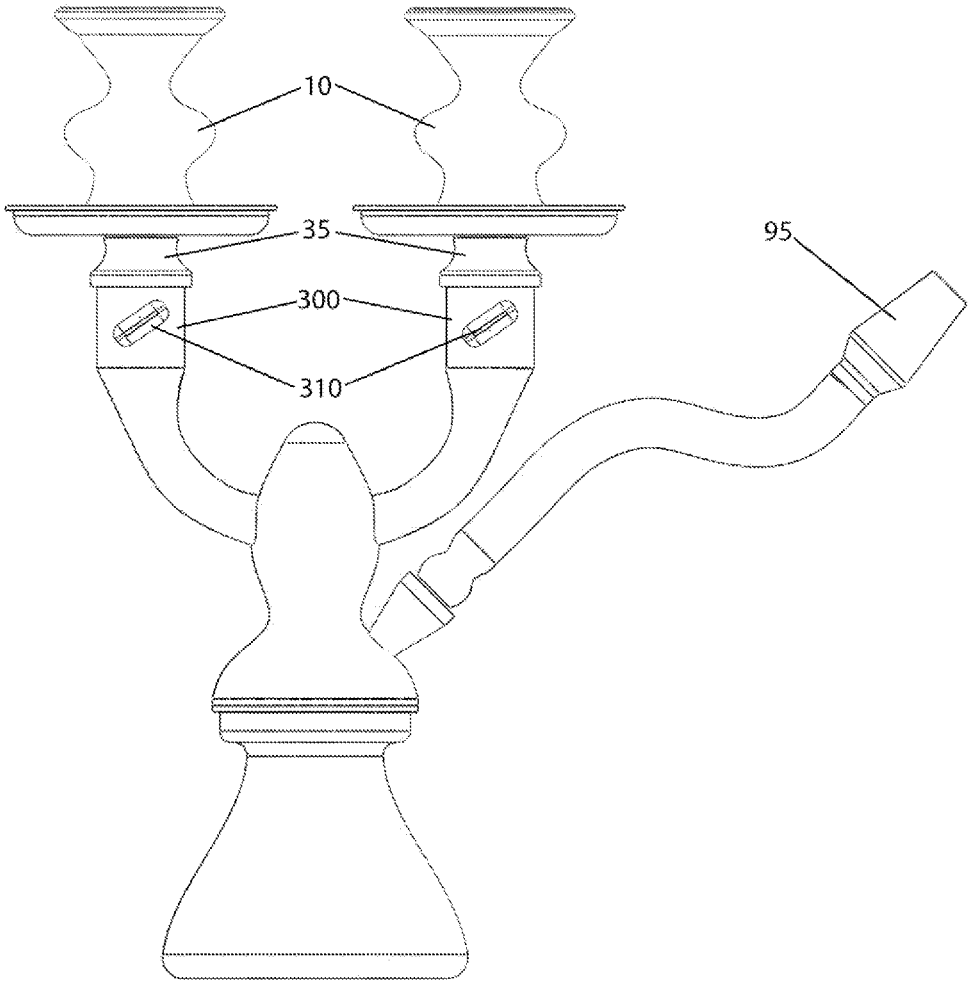
FIG. 9 shows a hookah or water pipe with multiple tobacco bowls attached to multiple tubes with a flow control device connected inline with each tube according to the second embodiment of the present invention.

An alternative embodiment is shown on FIG. 9 where a flow control device 300 such as a ball valve, is attached inline to each tube 20 before the tube 20 converges with the main stem tube 50, preferably directly below the bowl holders 35. It is preferred that the flow control device 300 be able to be fully opened and closed with the handle 310 or a push button. The flow control device 300 allows the user to control or fine tune the amount of smoke from each bowl 10 being added to the mixture of smoke that is inhaled by the user through the mouthpiece 95. Such capability allows the user to create the preferred blend of flavored tobacco consistently without having to mix by hand various tobaccos together. Further, the flow control device 300 allows the user to load all the bowls 10 with the same flavored tobacco and use one bowl 10 at a time by opening each flow control device 300 one at a time while the others remain closed. This extends the smoking time without having to clean and reload the bowl 10.

Figure 10A:
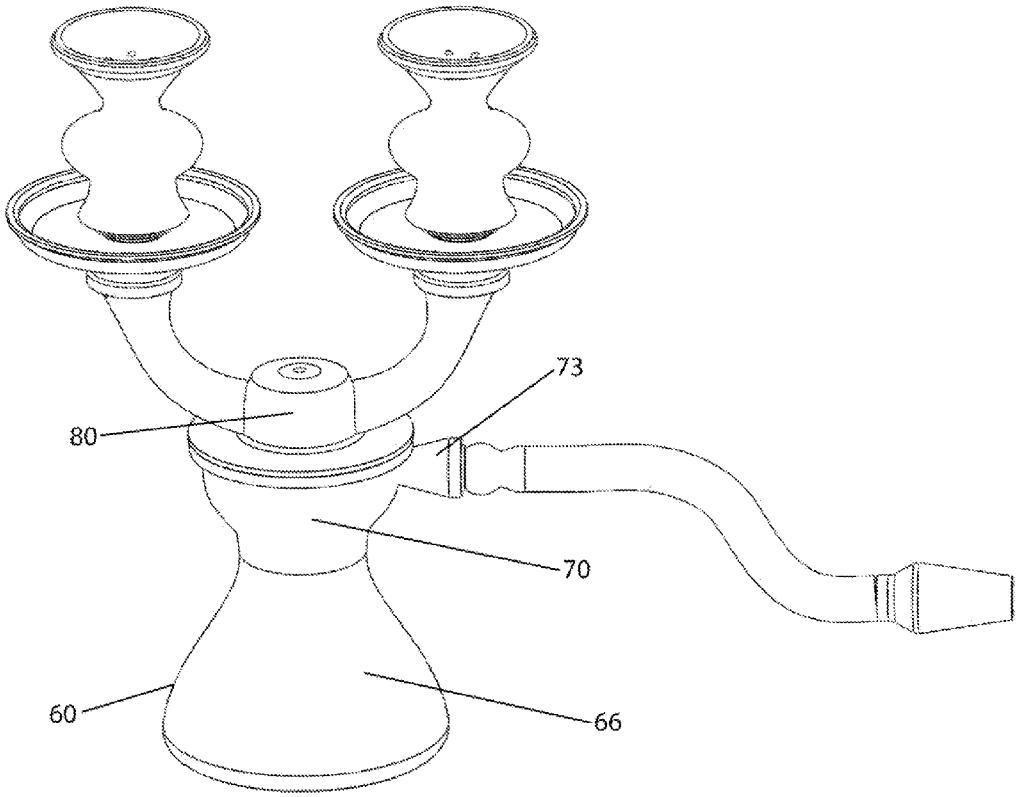
FIG. 10*a* shows a hookah or water pipe with multiple tobacco bowls according to the third embodiment of the present invention.
Figure 10B:
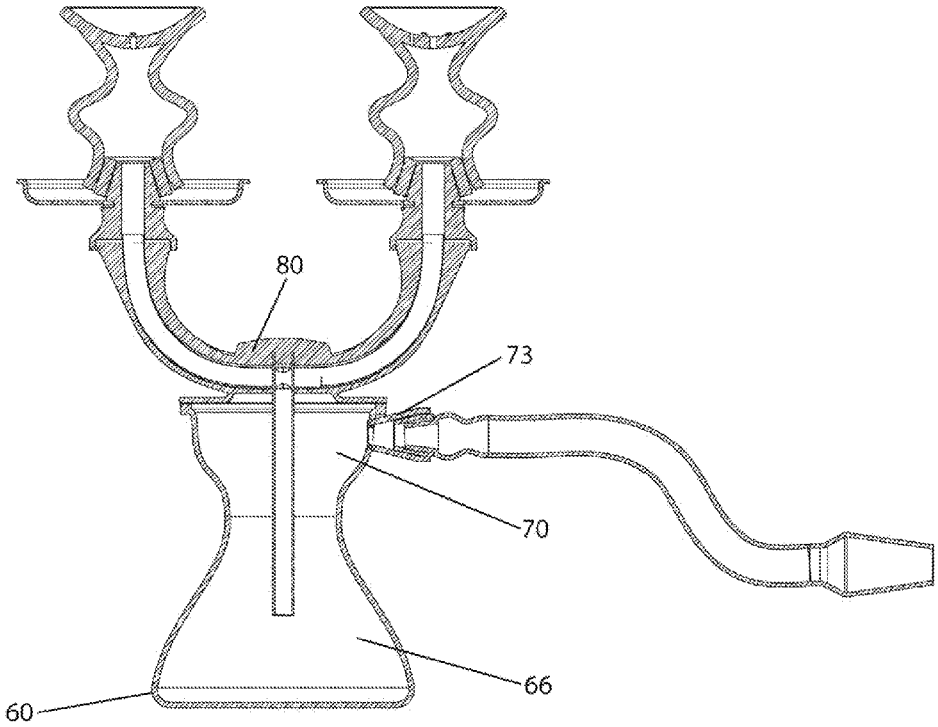
FIG. 10*b* shows a sectional view of a hookah or water pipe with multiple tobacco bowls attached to multiple tubes that are connected to the main stem tube according to the third embodiment of the present invention.
Figure 10C:
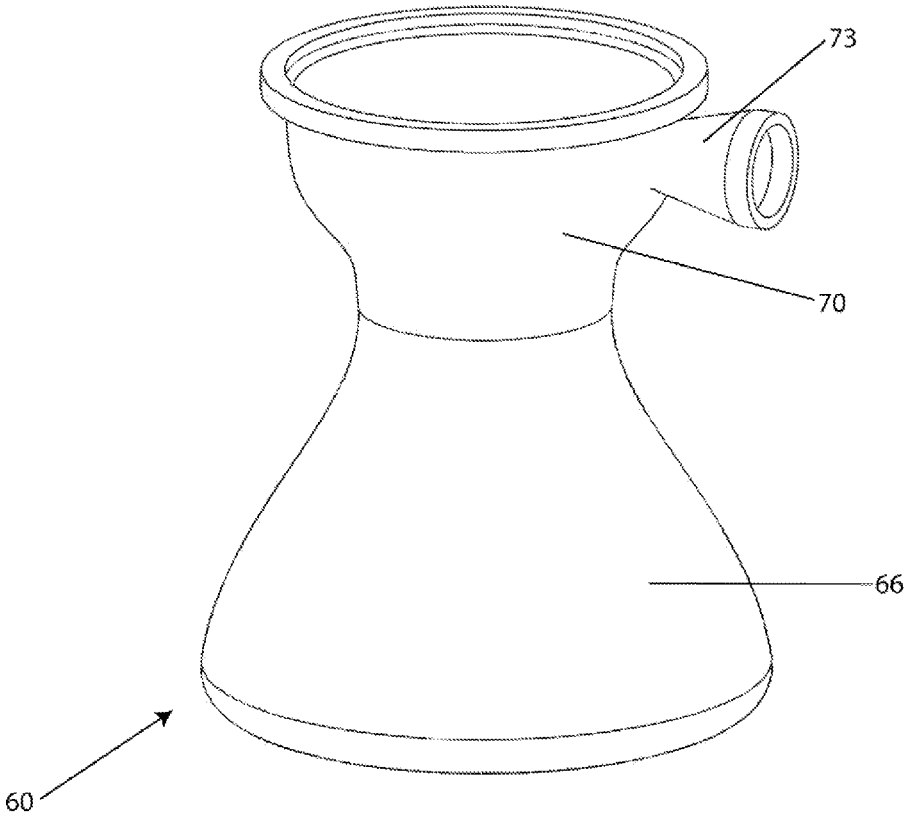
FIG. 10*c* shows a container used in a hookah or water pipe with multiple tobacco bowls according to the third embodiment of the present invention.

Another alternative embodiment is shown on FIG. 10*a* and FIG. 10*b* where the smoke chamber 70 is within the container 60 rather than inside the body of the hookah 80. The hose connector 73 is attached to the smoke chamber 70 in the container 60. As shown on FIG. 10*c*, the container 60 has both a water chamber 66 and a smoke chamber 70.

It is understood that the described embodiments of the invention are illustrative only, and that modifications thereof may occur to those skilled in the art. Accordingly, this invention is not to be regarded as limited to the embodiments disclosed, but to be limited only as defined by the appended claims herein.

What is claimed is:

1. A smoking apparatus comprising:

a container having an opening;

a smoke chamber in communication with said container through said opening;

a stem tube extending through said smoke chamber into said container through said opening;

a plurality of tubes attached to said stem tube;

a plurality of bowls in communication with said tubes and having a top surface with a plurality of holes;

a flow control device connected inline to said tubes to allow control over the flow of smoke through said tubes; and at least one hose in communication with said smoke chamber and arranged to permit a user to draw on one end of said hose to draw air through said holes on said bowls, through said tubes, through said stem tube, through said container, through said smoke chamber, and into said hose.

2. The smoking apparatus in claim 1, wherein said plurality of tubes extend upwardly.

3. The smoking apparatus in claim 1, wherein said plurality of bowls are attached to said tubes with a rubber grommet to create an airtight seal.

4. The smoking apparatus in claim 1, wherein said smoke chamber is attached to said container with an airtight seal that allows smoke to flow between said smoke chamber and said container.

5. The smoking apparatus in claim 1, wherein said hose is attached to said smoke chamber with an airtight seal that allows smoke to flow between said smoke chamber and said hose.

6. The smoking apparatus in claim 1, wherein said plurality of tubes are attached to said stem tube with an airtight seal that allows smoke to flow between said tubes and said stem tube.

7. The smoking apparatus of claim 1 further comprising a mouthpiece having a distal end and a proximal end wherein said distal end has an opening and wherein said proximal end is attached to said hose with an airtight seal that allows smoke to flow between said hose and said mouthpiece.

8. The smoking apparatus of claim 1 further comprising a plurality of plates having a hole wherein said tubes are inserted through said hole and wherein said plates are seated underneath said bowls.

* * * * *